US006554173B1

(12) United States Patent
Currie

(10) Patent No.: US 6,554,173 B1
(45) Date of Patent: Apr. 29, 2003

(54) ROBERTSON DRIVER

(76) Inventor: Neil L. Currie, P.O. Box 129, Apsley, Ontario (CA), K0L 1A0

( * ) Notice: Subject to any disclaimer, the term of this patent is extended or adjusted under 35 U.S.C. 154(b) by 0 days.

(21) Appl. No.: 09/188,701

(22) Filed: Feb. 12, 1998

Related U.S. Application Data

(60) Provisional application No. 60/039,029, filed on Feb. 21, 1997.

(51) Int. Cl.[7] ..... B21F 7/00

(52) U.S. Cl. ..... 227/119; 227/156; 81/461; 140/106

(58) Field of Search ..... 227/119, 156; 7/108; 140/102.5, 106, 118; 81/461

(56) References Cited

U.S. PATENT DOCUMENTS

| | | | | | |
|---|---|---|---|---|---|
| 173,356 | A | * | 2/1876 | Sloan | 81/461 |
| 1,934,347 | A | * | 11/1933 | Flesselles | 81/461 |
| 2,195,773 | A | * | 4/1940 | Foshee | 140/102.5 |
| 3,578,046 | A | * | 5/1971 | Curran | 81/461 |
| 4,257,159 | A | * | 3/1981 | Wingert | 7/108 |
| 4,485,852 | A | * | 12/1984 | Frazier | 140/102.5 |
| 4,680,996 | A | * | 7/1987 | Gold | 7/108 |
| 5,353,667 | A | * | 10/1994 | Wilner | 81/461 |
| 5,450,776 | A | * | 9/1995 | Kozak | 81/451 |
| 5,520,227 | A | * | 5/1996 | Kelley | 140/102.5 |

FOREIGN PATENT DOCUMENTS

| | | | | |
|---|---|---|---|---|
| GB | 860494 | * | 2/1961 | 227/156 |

* cited by examiner

*Primary Examiner*—Scott A. Smith
(74) *Attorney, Agent, or Firm*—Thompson & Gustavson, L.L.P.

(57) ABSTRACT

A Robertson driver is disclosed which has a slot (10) in the end of the tip (12) that can fit over a wire, enabling the user to manipulate the wire.

9 Claims, 1 Drawing Sheet

ROBERTSON DRIVER

CROSS-REFERENCE TO RELATED PATENT APPLICATIONS

This application claims the benefit of prior filed U.S. Provisional Application No. 60/039,029 filed Feb. 21, 1997.

TECHNICAL FIELD OF THE INVENTION

This invention relates to hand tools, and in particular to a Robertson Driver.

BACKGROUND OF THE INVENTION

In recent years, some screws, including wood screws, machine screws, etc. have been provided with square holes in their heads to take a square-tipped screwdriver. These screws and their drivers are called Robertson screws or drivers.

SUMMARY OF THE INVENTION

In accordance with one aspect of the present invention, a Robertson driver is provided which has a slot in the end of the tip thereof which can fit over a wire, enabling the user to manipulate a wire.

BRIEF DESCRIPTION OF THE DRAWINGS

A more complete understanding of the invention and its advantages will be apparent from the following detailed description taken in conjunction with the accompanying drawings, in which.

DETAILED DESCRIPTION OF THE INVENTION

You may have noticed in your hardware store in recent years that some screws—wood screws, machine screws, etc., have square holes in the heads to take square-tipped screw drivers. These screws and their drivers are called Robertson screws or drivers. They have been in use in Canada for much longer than in the U.S. simply because of the time it has taken to promote and market the Robertson system worldwide. Robertson, the company, now makes just the tips for the drivers.

Figure 1:
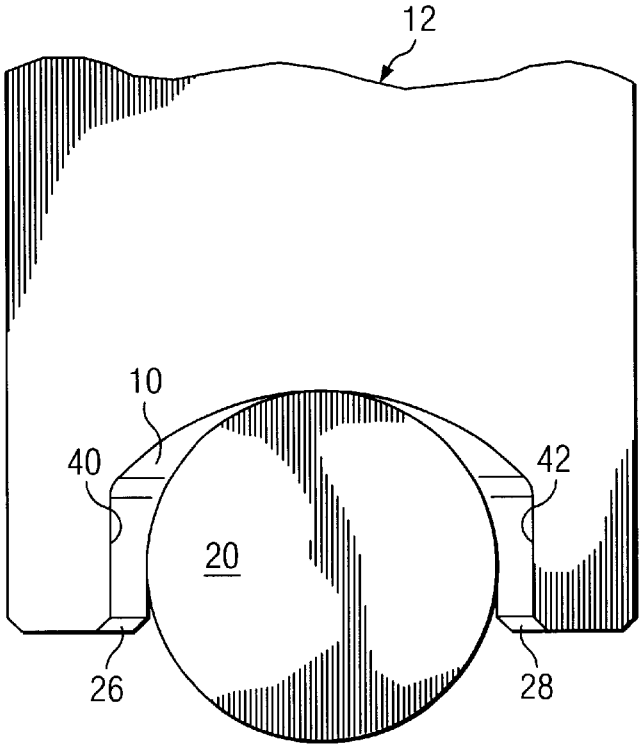
FIG. 1 is a side view of a Robertson driver formed in accordance with the teachings of the present invention.
Figure 2:
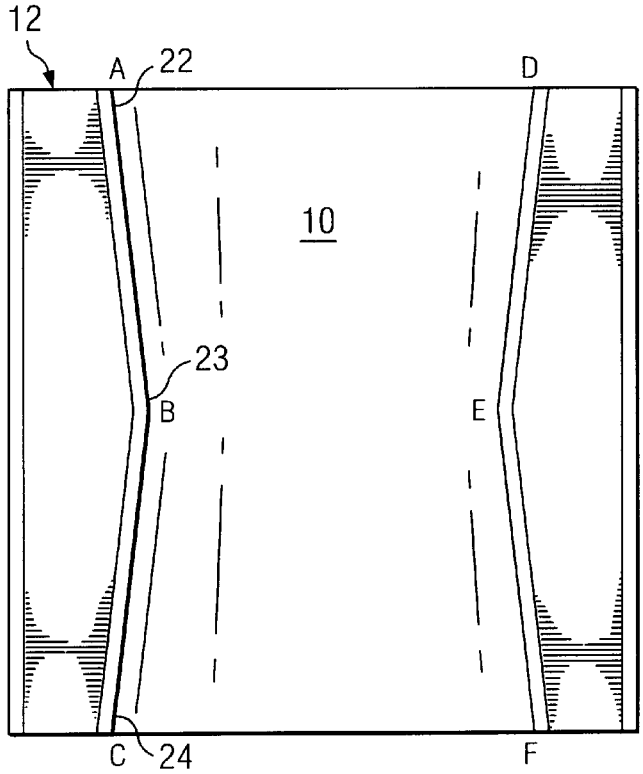
FIG. 2 is an end view of the end of the Robertson driver of FIG. 1.

My idea for the Robertson driver is to have a slot 10 in the end of the tip 12 that would fit over a wire, enabling the user to manipulate the wire (see FIGS. 1 and 2). This would be especially useful in the No. 12 drivers used by electricians installing household wiring but would probably be useful in the smaller and larger sizes as well.

At present, an electrician connecting uninsulated 14 gauge ground wire of a 110 volt circuit in typical situations such as a junction box, an outlet box or a switch box in fact already manipulates the wire around the grounding screw, using the present Robertson tip. It would be much easier, more dexterous and quicker if there were a slot in the end of the tip. The electrician would be able to trap the wire against the bottom of the junction box and in the slot, and would be able to move it sideways with more certainty than at present and would even be able to twist it around the grounding screw.

In some instances, the feature could also be used on the phase conductors.

At least four design features could be incorporated to enable the slot to slip easily over the wire and to ease manipulation:

1. The slot 10 should probably be a bit wider than the diameter of the wire 20.
2. The two edges 26, 28 of the slot should be chamfered.
3. The slot might widen a bit toward each end 22, 24, since the wire is never perfectly straight, so that only at its middle 23 would the width of the slot 10 approximate (being slightly larger than) the diameter of the wire 20. In consideration of strength of the bit, test trials should be conducted with and without widening the ends of the slot.
4. The depth of the slot 10 should probably be less than the diameter of the wire 20 but greater than half the diameter of the wire.

With these features, a bit of wriggling of the driver over the wire 20 pressed against the bottom of a junction box should quickly entrap the wire in slot 10, and manipulation of the wire should be easy. FIG. Nos. 1 and 2 show these features.

Following are descriptions of the figures which were drawn freehand on ¼" squared paper, ¼" representing 0.1 mm. They represent the driver used in electrical work with red handle, given the number 12 by Fuller Canada and with a bit 12 that appears to be 3 mm square.

FIG. No. 2 is the view from the end of the bit 12 showing the slot 10 widened at each end. The distance B–E is 1.7 mm to accommodate 14 gauge wire of 1.628 mm.

FIG. No. 1 is the view from the side of the bit 12 showing an end view of the wire 20 in the slot 10. Note the chamfer of the edges 26, 28 of the slot similar to the chamfer at the four outside corners of the bit. Note the straight vertical sides 40, 42 of the slot extend to more than halfway down the side of the wire when the wire is in the slot. Note the depth of the slot is less than the diameter of the wire. The clearance between the wire and the sides of the slot represents the widening of the end of the slot 10 as shown in FIG. No. 2.

Following is a table showing diameters of the most common gauges of electrical wire in 110v and 220v circuits:

| Gauge | mm | inch |
|---|---|---|
| 8 | 3.26 | 0.128 |
| 10 | 2.588 | 0.102 |
| 12 | 2.05 | 0.081 |
| 14 | 1.628 | 0.064 |

The larger gauges might be difficult to manipulate although electricians do develop strong wrists and forearms and the wire has to be dealt with in some way. Finer gauges used in electronics could certainly be manipulated quite dexterously.

Although a single embodiment of the present invention has been illustrated in the accompanying drawings and described in the foregoing detailed description, it will be understood that the invention is not limited to the embodiment disclosed, but is capable of numerous rearrangements, modifications and substitutions of parts and elements without departing from the scope and spirit of the invention.

I claim:

1. A Robertson driver for driving a screw, comprising:

a tip having a square cross section end, a slot formed in the end of the tip, the slot being formed by opposed edges, the edges being chamfered.

2. The driver of claim 1 wherein the slot is large enough to accept a 14 gauge wire.

3. The Robertson driver of claim 1 wherein the slot has a minimum width of 1.7 millimeters to accommodate a 14 gauge wire of 1.628 millimeters.

4. The Robertson driver of claim 1 for manipulating a wire having a diameter, the slot formed in the end of the tip having a depth less than the diameter of the wire.

5. The Robertson driver of claim 4 wherein the slot has straight vertical sides extending more than halfway down the side of the wire when the wire is in the slot.

6. The Robertson driver of claim 1 for manipulating a wire having a diameter, the slot having a depth less than the diameter of the wire but greater than half the diameter of the wire.

7. A method for manipulating a wire by use of a Robertson driver, comprising the steps of:

fitting the tip of a Robertson driver having a slot therein over the wire; and manipulating the driver to manipulate the wire held within the slot, the slot formed by opposed edges, the edges being chamfered.

8. A Robertson driver for driving a screw, comprising:

a tip having a square cross section end, a slot formed in the end of the tip, wherein the slot has a middle and ends, the slot widening toward the ends from the middle.

9. A Robertson driver for driving a screw, comprising:

a tip having a square cross section end, a slot formed in the end of the tip, the Robertson driver for use in manipulating a wire having a predetermined diameter, the slot formed in the end of the tip having a depth less than the diameter of the wire, the slot having chamfered edges, and straight vertical sides extending more than halfway down the side of the wire when the wire is in the slot.

* * * * *